United States Patent [19]

Cappel et al.

[11] Patent Number: 4,981,239

[45] Date of Patent: Jan. 1, 1991

[54] CONTAINER HAVING A DRAIN-BACK SPOUT

[75] Inventors: Jerome P. Cappel, Cincinnati; Jack A. Sneller; Thomas L. Reiber, both of Wyoming, all of Ohio

[73] Assignee: The Procter & Gamble Company, Cincinnati, Ohio

[21] Appl. No.: 292,672

[22] Filed: Jan. 3, 1989

[51] Int. Cl.[5] ..... B67D 1/16

[52] U.S. Cl. ..... 222/109; 222/111; 222/482; 222/572

[58] Field of Search ..... 222/108–111, 222/572, 482, 484; 141/381

[56] References Cited

U.S. PATENT DOCUMENTS

| | | | |
|---|---|---|---|
| 2,848,142 | 8/1958 | Livingstone | 222/111 |
| 2,851,196 | 9/1958 | Livingstone | 222/111 |
| 4,121,588 | 10/1978 | Geiger | 128/218 R |
| 4,550,862 | 11/1985 | Barker et al. | 222/109 |
| 4,604,470 | 8/1986 | Barlics | 215/232 |
| 4,640,855 | 2/1987 | St. Clair | 428/36 |
| 4,671,421 | 6/1987 | Reiber et al. | 215/228 |
| 4,773,560 | 9/1988 | Kittscher | 222/109 |
| 4,802,597 | 2/1989 | Dubach | 215/307 |
| 4,863,067 | 9/1989 | Krall | 222/111 |
| 4,890,768 | 1/1990 | Robinson | 222/109 |

FOREIGN PATENT DOCUMENTS 2390966 12/1978 France .

*Primary Examiner*—Kevin P. Shaver

*Attorney, Agent, or Firm*—R. C. Witte; T. H. O'Flaherty; R. C. Witte

[57] ABSTRACT

A container for liquid is disclosed, wherein the container has an improved self draining means featuring a radially inclined ramp which slopes downward from the container pouring spout in the radially outward direction. Beneath the drain ramp is an annular channel which receives liquids gravity draining from any azimuthal location on the ramp, and routes the liquids to a drain hole, returning the liquids to the container reservoir. One or more projections may be disposed within the annular channel to partially block it. This arrangement prevents any plastic shavings or other debris within the channel from migrating or being washed by the draining liquid to a location visible to the user or to the drain hole where such debris may contaminate the contents of the container.

4 Claims, 5 Drawing Sheets

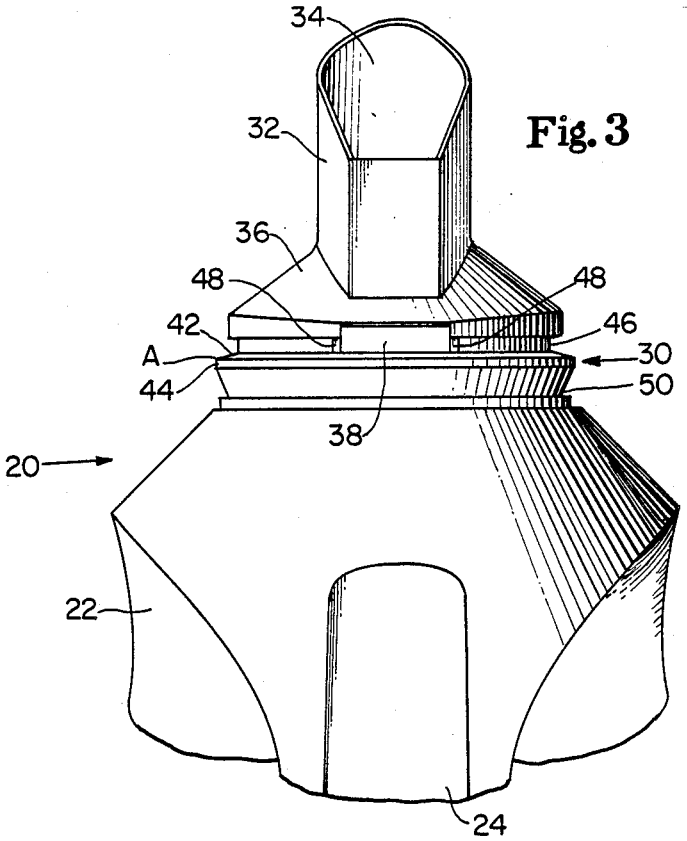
Fig. 3
Fig. 6
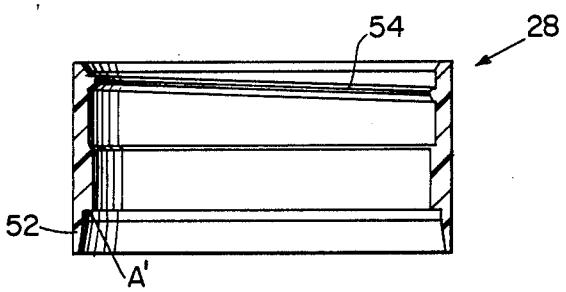

CONTAINER HAVING A DRAIN-BACK SPOUT

FIELD OF THE INVENTION

This invention relates to containers for dispensing liquids and more particularly to containers having a self draining means.

BACKGROUND OF THE INVENTION

Containers having self draining means to contain or otherwise control liquid contents spilled or dripped during the dispensing process are well known in the art. For example, U.S. Pat. No. 4,550,862, issued to Barker et al. on Nov. 5, 1985, discloses a container having a drain to collect liquids spilled or dripped during the dispensing process. U.S. Pat. No. 4,671,421, issued to Reiber et al. on June 9, 1987, discloses a container having a self draining insert friction welded to the container finish. U.S. Pat. No. 4,640,855, issued to St. Clair on Feb. 3, 1987, discloses a plastic container having an integral spout with a drain-back surface. A feature common to each of these patents is that the self draining means has a principal inclination from the front of the container to the back of the container, where the drain hole is located. However, containers having a radially inclined drain means are also known in the art.

The front to back inclination does not provide for the most efficient self draining of liquid contents spilled or dripped as a result of pouring, or which otherwise occurs during the dispensing process. For example, liquids which drip from the front of the container pouring spout have a considerably longer drainage path than liquids which drip from the back of the pouring spout. Given that the front of the pouring spout is usually the region to encounter most liquids during the pouring operation, the situation is exacerbated. Furthermore, when the closure of the container is used as a measuring cup, to provide dosing of the container contents, residual liquids often drain from the entire circumference of the closure and may not encounter the self draining means near the drain hole.

One problem associated with liquids which do not quickly and efficiently drain back into the container reservoir is that frequently the liquids are sticky and build up a residue. This residue impedes subsequent drainage of liquids later spilled or dripped during the pouring operation. Furthermore, such liquids are often unsightly and may present an objectionable appearance to the user. Therefore, it is desirable to drain liquids back into the container reservoir as efficiently as possible.

Containers with a self draining means commonly have components joined by friction welding. The friction welding operation generates plastic shavings. If the plastic shavings are not collected and retained, the shavings may either fall into the container, and potentially contaminate any contents therein, or otherwise be seen by and present an objectionable appearance to the user.

Against this backdrop of structural criteria the container must be properly sized, have a closure suitable for use as a measuring cup, a spout that is of sufficient length to allow the user to observe the liquid as it is being dispensed and meet aesthetic requirements.

BRIEF SUMMARY OF THE INVENTION

It is therefore an object of this invention to provide a container and closure suitable for measuring and dispensing of liquids. It is also an object of this invention to provide a container which efficiently self drains liquids from any location on the circumference of a measuring cup closure back into the reservoir and, particularly, a container which efficiently drains liquids from the front of the pouring spout. It is further an object of this invention to provide a container which can accommodate friction welding of the components without substantial exposure of any plastic shavings generated by the friction process to either the container contents or the areas of the container visible to the user.

In accordance with one aspect of the present invention, there is provided an improved package comprising a hollow container for housing a liquid. The container has a body with a base at the lower end and an integral upwardly extending pouring spout at the upper end. The package also has a drain means comprising a ramp contiguous the spout base and intermediate the spout and body. The ramp has an inclination downward from the spout in the outwardly radial direction. The package further has an upwardly projecting fluid retaining means fused to the container in a liquid type relation. The fluid retaining means circumscribes the periphery of the ramp in a spaced relationship to provide an annular gap between the ramp periphery and the fluid retaining means. The drain means also has an annular channel in fluid communication with the annular gap, whereby the annular channel receives liquids draining from the ramp. At least one of the ramp and the annular channel are in fluid communication with a drain hole which leads to the interior of the container.

BRIEF DESCRIPTION OF THE DRAWINGS

While the Specification concludes with claims particularly pointing out and distinctly claiming the present invention, it is believed that the same will be better understood from the following description taken in conjunction with the accompanying drawings wherein like parts will be given the same reference number in the different figures and related parts are designated by a prime symbol:

FIG. 3 is a fragmentary rear elevational view of the embodiment of FIG. 1 without the fluid retaining means and closure;

FIG. 6 is a vertical sectional view of the fluid retaining means of FIG. 2, taken along line 6—6 of FIG. 2;

DETAILED DESCRIPTION OF THE INVENTION

As used herein, the term "base" of the container refers to a generally horizontal bottom surface of the container, upon which the container rests when not in use.

The term "axis" of the container refers to an imaginary line generally perpendicular to the plane of the base and extending through the center of the closure of the container.

The term "dispensing position" refers to a generally horizontal alignment of the container axis suitable for dispensing of the contents from the container.

The term "back" of the container refers to the half of the container which is above the axis and faces upwardly when the container is in the dispensing position and is inclusive of a handle, if one is provided with the container.

The term "front" of the container refers to the half of the container which is below the axis and faces downwardly when the container is in the dispensing position and is opposite the back of the container.

The term "side" of the container refers to halves of the container oppositely disposed about a vertical plane which bisects the container when it is in the dispensing position.

The term "liquids" refers to, but is not limited to, a liquid fabric softener having a viscosity of about 40–150 centipoises, and typically about 80–90 centipoises, as measured at 21.1° C. on a Brookfield Model LVF Viscometer, utilizing a Number 2 spindle rotating at 60 rotations per minute.

The term "spilled liquids" refers to contents of the container which drip from the edge of the pouring spout or the closure as a result of the dispensing process or upsetting the container while the closure is attached.

Figure 1:
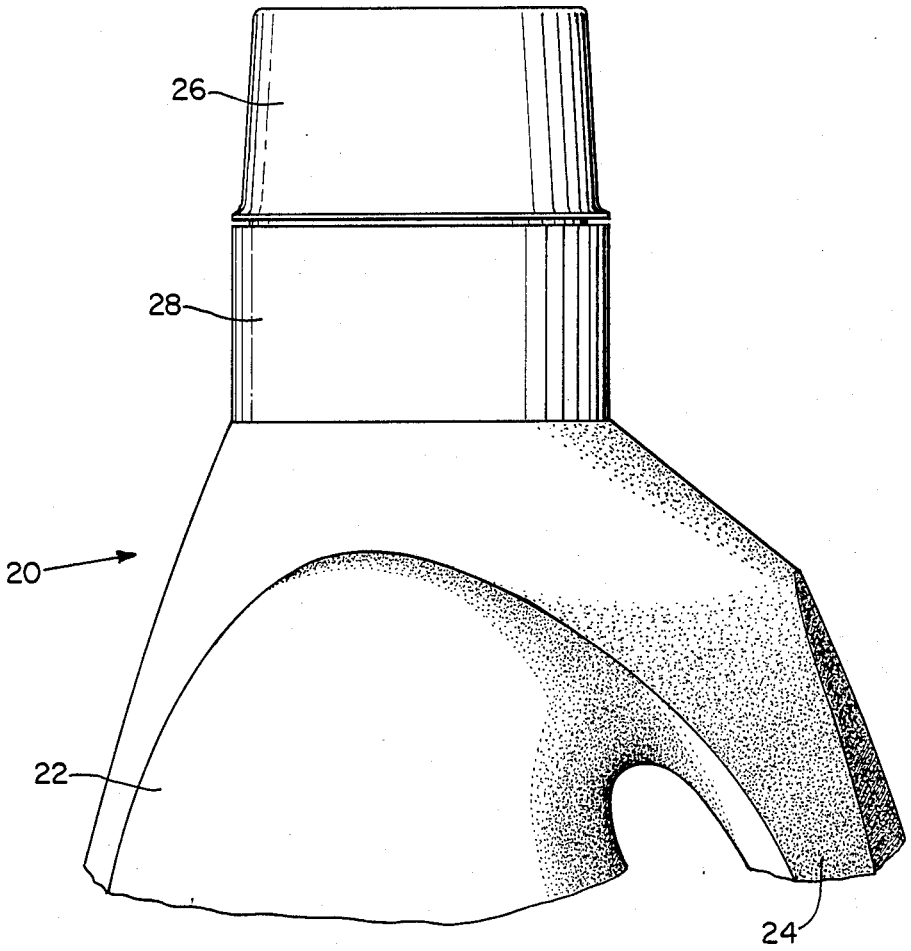
FIG. 1 is a fragmentary side elevational view of the package of the present invention.

As illustrated in FIG. 1, the invention comprises a container 20 suitable for holding liquid products and the like. The container 20 has a body portion 22 which provides a reservoir for the liquids contained therein. The balance of the container body 22 (not shown) may be of any desired configuration which is suitable for manual dispensing of the container contents and provides a closed-end reservoir for retaining the contents until dispensation is desired. Preferentially the back of the container 20 is provided with a handle 24, integrally molded therewith, to provide a gripping means to facilitate holding and carrying the container 20 and dispensing of its contents. The container 20 has a removably attached closure 26 to prevent inadvertent spillage or loss of freshness of the contents of the container 20. The closure 26 may also be used as a measuring cup, to ensure the desired quantity of liquids is dispensed. The closure 26 is attached to the container 20 at the upper, or distal, end of a generally cylindrical fluid retaining means 28. The lower, or proximal, end of the fluid retaining means 28 is fused to the container 20 in a liquid-tight relation. The container 20 is constructed by blow-molding any moldable polymeric material, preferably high density polyethylene.

Figure 2:
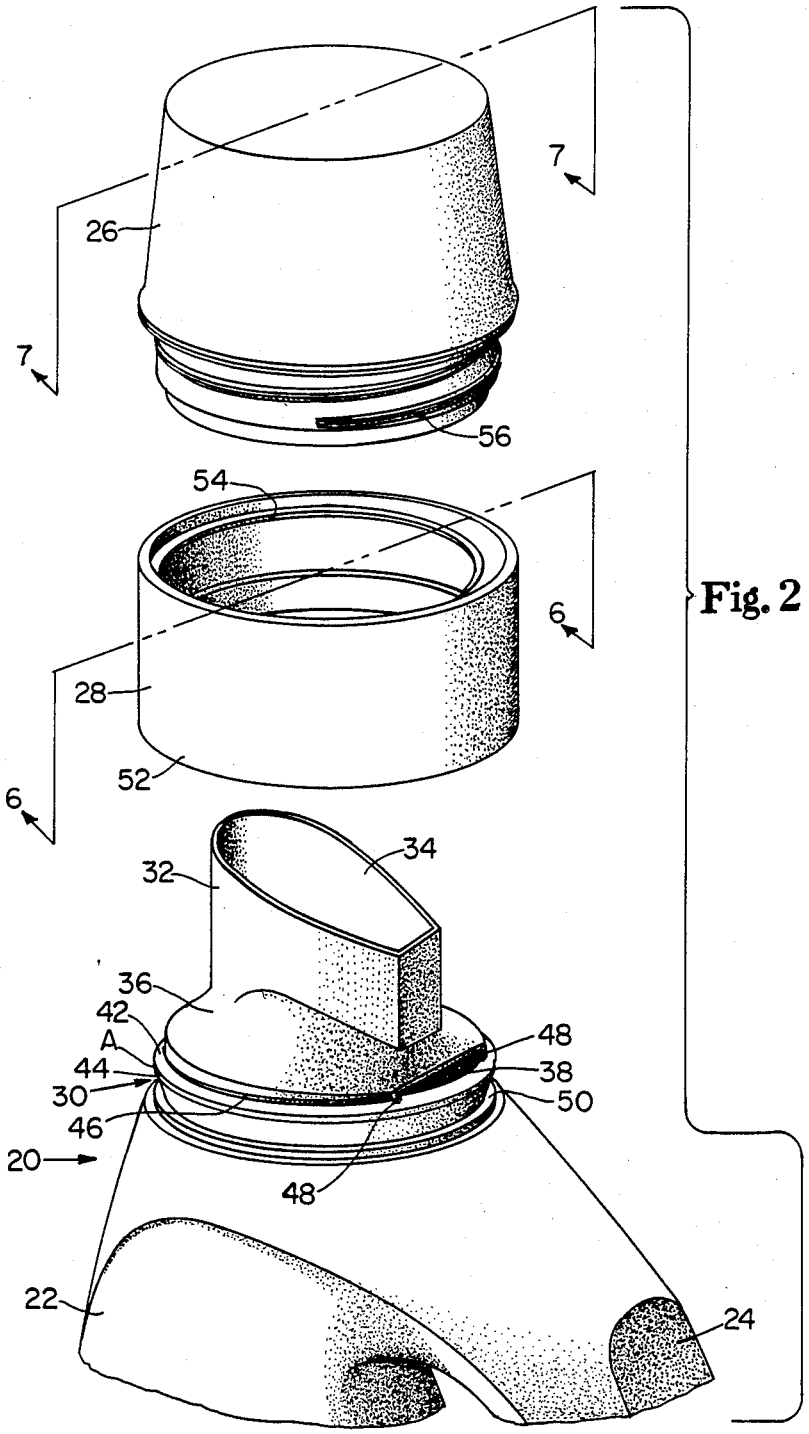
FIG. 2 is a fragmentary, exploded, perspective view of the embodiment of FIG. 1.

Referring to FIGS. 2 and 3, the container 20 further comprises an integral, upstanding, outwardly extending pouring spout 32 having an orifice 34 through which the contents of the container 20 are dispensed. The spout 32 is circumscribed by and generally centered on a radially inclined ramp 36, which overlies an annular undercut, or channel, 46 in the container finish. At the back of ramp 36 and channel 46 is an elongate drain hole 38.

The pouring spout 32 should be long enough to overhang the fluid retaining means 28 when the container 20 is in the dispensing position but fit within the selected closure 26 when it is in sealing engagement with the fluid retaining means 28. The spout 32 should also be long enough that the user has an opportunity to observe the liquids being dispensed and is able to rest the spout 32 on the closure 26 during pouring. The side edges of the spout 32 are preferentially inclined upwardly towards the front of the container 20. For the container 20 described herein, a spout 32 having an axial length, as measured at the front of the container 20, of about 27.0 mm (1.06 inches) is sufficient. The front wall of the spout 32 is preferentially concave towards the spout orifice 34, to form a channel for the liquids being dispensed. The cross sectional area of the spout orifice 34 is not critical, but should be sized so that the liquids may be easily poured and measured without spilling.

The spout orifice 34 is formed by a shear blade trimming operation after the container 20 is blow molded and cooled. During this operation, the container 20 is rigidly held while a shear blade cuts sideways through the spout 32, thereby forming the spout orifice 34 and severing any flash from the top of the container 20. Prior to forming the spout orifice 34, the top of container 20 has a moil (not shown) of any configuration suitable for the blow molding operation used to form the container 20. The moil is removed by the trimming operation which forms spout orifice 34.

The spout 32 is circumscribed by an integral inclined ramp 36, shown in FIG. 3, which is part of the container drain means. The ramp 36 comprises an inclined surface having a slope, or inclination relative to the base, downward from the spout 32 in the radially outward direction (towards fluid retaining means 28 in the assembled container 20). Preferably the ramp 36 has a principal inclination in the outwardly radial direction. The term "principal inclination" refers to the greatest angular deviation from the base of the container 20. The ramp 36 may also have a minor inclination from the front of the container 20 to the back of the container 20, where a drain hole 38 is provided. The term "minor inclination" refers to an angular deviation from the base of the container 20 which is lesser than the principal inclination. It is to be recognized that the ramp 36 could have a minor inclination towards the front or either side of the container 20, but, as described below, the drain hole 38 is preferentially disposed at the back of the container 20 and the principal and minor ramp 36 inclinations are adjusted to accommodate the drain hole 38 location.

The minor inclination of the ramp 36, downward from the front to the back of the container 20, where the drain hole 38 is disposed, is about 2° to 4° relative to the horizontal, while the radial inclination of the ramp 36, from the spout 32 to the fluid retaining means 28, is somewhat steeper, about 40° to about 50° relative to the horizontal. This combination of inclines causes spilled liquids to gravity drain principally towards the periphery of the ramp 36 and, to a lesser extent, directly towards drain hole 38. This arrangement provides efficient drainage of spilled liquids from any azimuthal location, not just that spilled liquids which occurs near the back of the container 20.

The drain means further comprises an annular channel 46 which is formed in the container finish below the ramp 36. Any liquids draining from the periphery of the ramp 36 will be received by the channel 46. The channel 46 is generally horizontal and leads to drain hole 38. The cross sectional area and shape of the channel 46 are not critical, so long as liquids do not encounter excessive flow resistance therein, and are thereby prevented from reaching drain hole 38 in an efficient manner. For the embodiment described herein, a channel 46 also having a cross sectional area of about 4 to 5 square millimeters is sufficient. The walls defining channel 46 are preferentially formed integral with the container 20 as part of the blow molding process. As described below, the channel 46 may also serve an independent function related to the fusing of the fluid retaining means 28 to the container 20.

Spilled liquids gravity drain from the inclined ramp 36, through channel 46, to the elongate drain hole 38 which has projections 48 disposed on either side. The drain hole 38 is in fluid communication with the interior of the container body 22 and the reservoir of liquids contained therein. The drain hole 38 is preferentially disposed at the lowest axial elevation of the ramp 36 so that spilled liquids do not collect in a sump having an elevation lower than that of the drain hole 38. The drain hole 38 is also preferentially located at the back of the container 20 so that during pouring, or dispensing, the user will not simultaneously pour liquids from both the spout orifice 34 and the drain hole 38. Furthermore, if the drain hole 38 is above the plane of the liquid when the container 20 is in the dispensing position, the drain hole 38 will vent the container 20 and prevent glugging, or splashing, of the liquids, providing for a smoother pouring operation.

To insure that the drain hole 38 is at the lowest elevation of the ramp 36, the drain hole 38 is preferentially formed by a trimming operation which is performed after the container 20 and ramp 36 are blow molded and which operation removes a portion of the lowest elevation of the ramp 36 and part of channel 46. During the trimming operation the container 20 is rigidly held and a shear blade, applied in a sideways direction, severs the circular segment shaped portion of the back of the ramp 36 which is between and defined by the location of projections 48. The same operation severs and removes the portion of channel 46 which is immediately beneath this segment of the ramp 36. By severing the back of ramp 36 and channel 46 from the container 20, the ramp 36 and channel 46 are placed in fluid communication with the interior of the container body 22.

Figure 4:
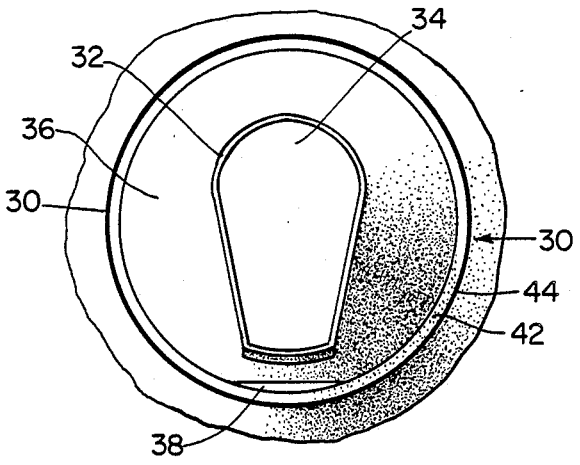
FIG. 4 is a fragmentary, top plan view of the embodiment of FIG. 3.

The drain hole 38 extends transversely to either side of the back of the spout 32, as shown in FIG. 4, to more efficiently intercept liquids flowing from either side of the ramp 36 or channel 46. The cross sectional area of the drain hole 38 is not critical, so long as spilled liquids are quickly returned to the container 20 reservoir. For the container 20 described herein, a drain hole 38 of about 19 mm (0.75 inches) in transverse dimension and about 0.8 mm (0.3 inches) in maximum radial dimension is sufficient.

Referring back to FIG. 3, circumscribing the drain means is the collar attachment base 30 to which the fluid retaining means 28 is attached. The fluid retaining means 28 is fused, or otherwise bonded, to the collar attachment base 30 in any manner which produces a liquid tight sealing relation, including but not limited to adhesive or solvent bonding, being integrally molded, or welding, preferentially friction welding. It is to be recognized that the structural details of the collar attachment base 30 and the fluid retaining means 28 will vary somewhat with the materials selected and the equipment used for the friction welding operation.

The collar attachment base 30 comprises a generally horizontal annular wall 42, outwardly terminating at corner A and a vertical wall 44 below and adjacent corner A. The fluid retaining means 28 is fused to the collar attachment base 30 at corner A by attachment to the vertical wall 44 and horizontal wall 42. For the container 20 and collar attachment base 30 described herein, a corner A having a diameter of about 59 mm (2.32 inches) has been found to work well.

To adapt the container 20 for friction welding of the fluid retaining means 28 to the collar attachment base 30, the thickness of the vertical wall 44 and horizontal wall 42 should be greater than about 1.1 mm (0.043 inches) to provide sufficient rigidity and parent material for welding of the fluid retaining means 28 thereto. The vertical wall 44 extends downwardly from corner A about 1.0 mm (0.040 inches) and the horizontal wall 42 extends radially inwardly of corner A about 1.8 to about 2.0 mm (0.070 to 0.080 inches) to provide a sufficient weld surface.

The generally horizontal wall 42 defines the bottom of channel 46, which also serves as an upper flashtrap to collect plastic shavings generated between the horizontal wall 42 and the fluid retaining means 28 by the friction welding process. The upper flashtrap, or channel 46, has a minimum horizontal depth of about 2.0 mm (0.08 inches), a minimum height of about 2.2 mm (0.09 inches) and an inside diameter at the internally disposed vertical wall of channel 46 of about 50.3 mm (1.98 inches) to ensure a sufficient volume for collection of the plastic shavings and an adequate flow path for any spilled liquids draining therethrough. The channel 46 is concealed from view by the fluid retaining means 28 after it is fused to the container 20.

As described above, the upper flashtrap, or channel 46, is in fluid communication with the drain hole 38 and receives spilled liquids from the ramp 36. As spilled liquids drain off ramp 36 and through channel 46, it is important to prevent plastic shavings in the channel 46 from being washed into drain hole 38 and contaminating the contents of the container reservoir. Furthermore, plastic shavings collected in channel 46 are potentially visible when one looks into the drain hole 38. To obviate either from occurring, a means is provided to restrict the shavings to the portion of the channel 46, which is not adjacent the drain hole 38.

Two generally planar projections 48 bridge the channel 46 and are located about 19 mm (0.75 inches) apart at an azimuthal position adjacent each end of the elongate drain hole 38. The shape of the projections 48 corresponds with the shape of the cross section of the channel 46, so that the projections 48 are substantially congruent thereto.

The projections 48 are preferentially integral with the container 20 and channel 46 and formed during the blow molding operation that produces the container 20. The projections 48 are radially coextensive of the ramp 36, leaving a radial gap between the projections 48 and fluid retaining means 28 of about 0.6 mm (0.025 inches) through which spilled liquids may drain into the channel 46 below and from the channel 46 around projections 48 and through the drain hole 38 to the container interior. It is to be recognized that the dimensions of the radial gap must be adjusted to suit the viscosity of the spilled liquids, cross section of channel 46 and size of the plastic shavings. Preferentially the projections 48 have a circumferential dimension which does not exceed the wall thickness of the collar attachment base 30, to prevent interfering with the fluid retaining means 28 when it is fused to the container 20. The projections 48 may be of any desired thickness, so long as the cross section of the channel 46, through which spilled liquids are drained, is only partially blocked.

Figure 5:
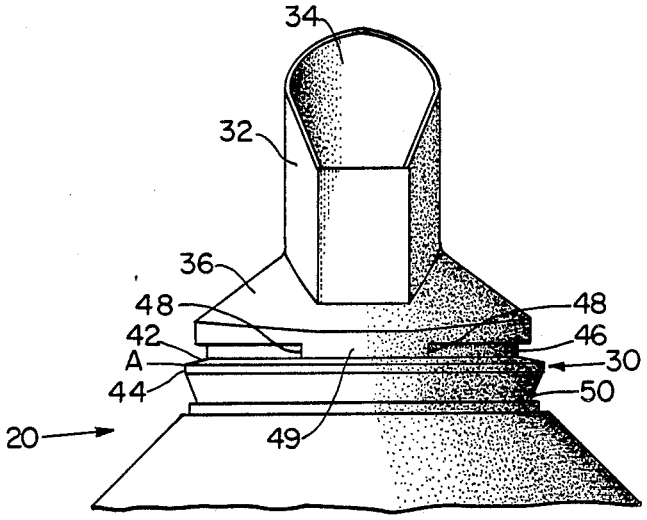
FIG. 5 is a fragmentary rear elevational view of the embodiment of FIG. 3 prior to forming the projections and drain hole.

A preferred opportunity to form projections 48 occurs during the trimming operation which forms drain hole 38. As shown in FIG. 5, a container 20 having an elongate bubble 49 radially coextensive of ramp 36, centered on the back of channel 46 and subtending the arc between the outer edges of to-be-formed projections 48 is provided. By adjusting the stroke and position of the shear blade which forms drain hole 38 to intersect bubble 49 radially outwardly of (towards the back) an end of the bubble 49, pass through the bubble 49 in a sideways direction and exit the bubble 49 in a mirror-image position of the location where the blade first entered bubble 49, the projections 48 are formed concurrently with drain hole 38, eliminating the need for a separate operation.

The projections 48 prevent shavings generated during the friction welding operation from being visible when one looks into the drain hole 38. Any shavings collected in the portion of the upper flashtrap, or channel 46, not adjacent the drain hole 38 will be retained therein by the projections 48 and thereby prevented from migrating, or being carried by draining liquids, to the drain hole 38. Between the projections 48 only a negligible amount of shavings is generated by the friction welding operation, because the projections 48 are so closely spaced. Obviously more than two projections 48 could be disposed in channel 46, however, two projections 48 have been found satisfactory to prevent undesired plastic shavings from contaminating the container contents or being seen by the user.

Plastic shavings generated between the vertical wall 44 adjacent corner A are likewise collected in a lower annular flashtrap 50 having a generally triangular cross section, a height of about 7.6 mm (0.30 inches) and a minimum diameter of about 55 mm (2.18 inches) at the lower interior corner. Because the lower flashtrap 50 is not in fluid communication with the drain hole 38, no projections 48 are necessary, as any plastic shavings resulting from the friction welding operation are not visible when the user looks into the drain hole 38 and cannot be washed into the container reservoir.

As shown in FIG. 2, the fluid retaining means 28, or collar, is generally cylindrical and is adapted to be attached to the container 20 coaxial of spout 32, at the collar attachment base 30. The proximal end, or bottom, of the fluid retaining means 28 is fused to the collar attachment base 30 of the container finish in a liquid tight relation, such as a seal, formed by the friction welding operation, thereby channeling any spilled liquids towards the drain hole 38 via the drain means, specifically ramp 36 and channel 46. It is, of course, necessary that the liquid tight seal be maintained throughout the full circumference of the fluid retaining means 28, so that any spilled liquids do not progress between the fluid retaining means 28 and the collar attachment base 30 and run down the outside of the container 20, creating a messy and unsightly appearance.

Referring to FIG. 6, the upwardly projecting fluid retaining means 28 is shaped like an open cylinder, having a diameter somewhat greater than the axial length. The fluid retaining means 28 is made of any moldable polymeric material, preferentially injection molded polyethylene. The axial length is not critical, so long as the axial dimension is sufficient to accommodate any volume of spilled liquids until such liquids are returned to the container reservoir and the distal end of the spout 32 extends beyond the fluid retaining means 28 a distance sufficient to allow the user to rest the spout 32 on the closure 26 during pouring. For the embodiment described herein, a fluid retaining means 28 having an axial length of about 32 mm (1.25 inches) is adequate. The fluid retaining means 28 need not be of constant diameter (as shown) but may be any desired shape, such as frustroconical.

The fluid retaining means 28 is attached to corner A of the collar attachment base 30 at corner A'. A fluid retaining means 28 having a diameter at corner A' of about 59 mm (2.32 inches) has been found suitable for the collar attachment base 30 described above. The vertical wall adjacent and below Corner A' should maintain this diameter for an axial distance of at least about 1.0 mm (0.040 inches) to provide an adequate weld surface. Likewise, the horizontal wall adjacent corner A' should have a radial dimension of about 1.6 mm (0.062 inches) to provide an adequate weld surface. Depending from the vertical weld surface is the annular skirt 52 which conceals the lower flashtrap 50 from view. If desired, the inside wall of the skirt 52 may be tapered to provide a clearance between the skirt 52 and container 20 for the friction welding operation. It is to be recognized that if a different manner of fusing the fluid retaining means 28 to the container 20 is selected, the structural details of the fluid retaining means 28 must be adjusted accordingly.

The inside diameter of the fluid retaining means 28 circumscribes the drain ramp 36 periphery in a spaced relationship to provide an annular gap between the interior wall of fluid retaining means 28 and the peripheries of the ramp 36 and projections 48. The annular gap is in fluid communication with the channel 46 and has a radial dimension of about 0.08 mm to about 1.3 mm (0.003 to 0.050 inches), preferably about 0.3 mm to about 0.6 mm (0.010 to 0.025 inches), and more preferably about 0.4 mm (0.016 inches). The steep radial inclination of the ramp 36 causes liquids thereon to quickly flow from the ramp 36 through this gap and into channel 46, where such liquids cannot readily be seen by the user. Liquids inside the channel 46 spread substantially evenly therethroughout, flowing between projections 48 and the fluid retaining means 28 to drain hole 38.

The fluid retaining means 28 also comprises a means for attaching the closure 26 to the container. Any suitable means of attachment which is liquid tight (in case the container 20 is upended with the closure 26 attached) may be used, including, but not limited to, snap beads, friction fits, flip-caps, external screw threads and preferentially internal screw threads 54.

Internal screw threads 54 are preferred because the complementary attachment means on the closure 26 is, by necessity, external screw threads 56 which fit within the fluid retaining means 28. By disposing the closure 26 wholly within the fluid retaining means 28, any spilled liquids which may drip from the edge of closure 26 are returned to the container reservoir and do not run down the exterior surface of the container 20.

To more easily friction weld the fluid retaining means 28, to the collar attachment base 30, both components are preferentially molded from the same batch of polymeric resin. The fluid retaining means 28 and the collar attachment base 30 should have a maximum ovality, defined as the difference between any two perpendicular diameters, of not more than about 0.5 mm (0.020 inches), otherwise a liquid tight seal is more difficult to obtain. During the friction welding operation the fluid retaining means 28 is rotated about the axis of the container 20 and pressed axially towards container 20. If desired, the container 20 may be preheated before friction welding.

Figure 7:
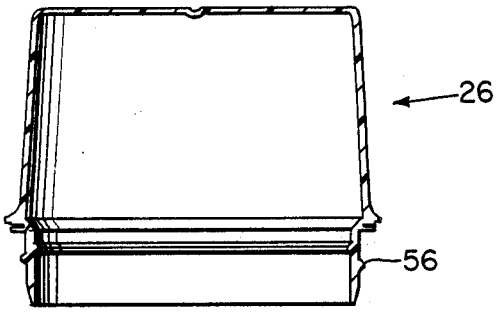
FIG. 7 is a vertical sectional view of the closure of FIG. 2, taken along line 7—7 of FIG. 2.

The closure 26, illustrated in FIG. 7 is generally cup shaped, having a circular end wall and a depending skirt-like side wall. The closure 26 is preferentially injection molded of a dense polymeric material, such as a copolymer of high density polyethylene and polypropylene, for compressive strength. The closure 26 has an attachment means such as an external screw thread 56, adapted to engage with complementary attachment means, such as an internal screw thread 54, on the fluid retaining means 28 and should be capable of establishing a primary seal at the distal end of the fluid retaining means 28. The selected closure attachment means 56 is preferentially exterior the closure skirt, as noted above, so that the closure 26 fits within or is otherwise nested inside of the fluid retaining means 28 when attached to the container 20 and any spilled liquids within the closure 26 are returned to the container 20 reservoir via the drain means.

The inside of the closure 26 may be provided with indicia (not shown), such as a line, to indicate when the closure 26 contains the desired dose of liquid. The exterior of the closure 26 may be provided with axially disposed ribs or other embossments (not shown) to aid in gripping the closure 26 for engagement and disengagement of the attachment means.

Figure 8:
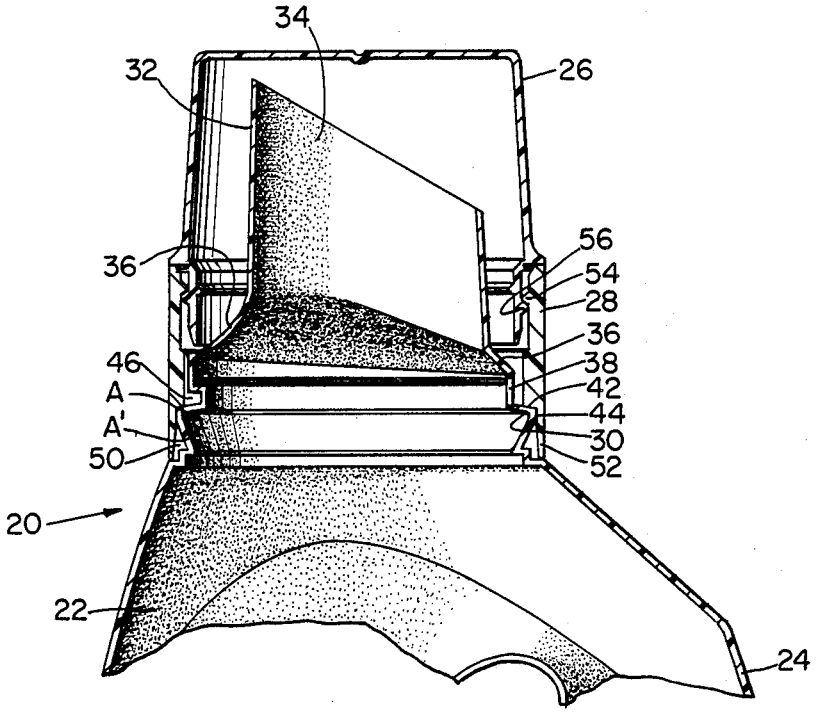
FIG. 8 is a fragmentary, vertical sectional view of the embodiment of FIG. 1.

The volume and axial height of the closure 26 are related to the dosage requirement of the liquid and the space envelope of the shelf on which the package will be stored while not in use or awaiting sale. The closure 26 preferentially has a volume slightly greater than that of the desired dose, so that the proper amount of liquid can be dispensed from the container 20 to the closure 26 in a single pouring operation. The axial dimension of the closure 26 is adjusted to bring the total package height within the axial space envelope of the shelf where the package is kept. It is also necessary that closure 26 accommodate the spout 32 and ramp 36 when the closure 26 is attached to the fluid retaining means 28, as shown in FIG. 8. Therefore, the axial length of the closure 26, as measured between the closure attachment means 56 and the circular end wall, exceeds the axial distance from the fluid retaining means attachment means 54 to the distal end of the spout 32, otherwise interference will result. The diameter of the open end of closure 26 is determined by the diameter of the fluid retaining means 28 since this is where the complementary attachment means are engaged. For the embodiment described herein, a closure 26 having an inside diameter of about 54 mm (2.13 inches) and an axial dimension of about 46 mm (1.81 inches) has been found to work well.

In operation, the container 20 is formed and the fluid retaining means 28 is fused to the collar attachment base 30. Thereafter, the desired quantity of liquid is placed inside the container reservoir. The closure 26 is then placed on the container 20 in a liquid tight engagement using the complementary attachment means. To dispense liquids from the container 20 the user unscrews, or otherwise disengages, the closure 26 from the fluid retaining means 28 and preferentially turns the closure 26 upside-down to use it as a measuring cup for dosing of liquids by filling the closure 26 to the desired level. The liquid is thereafter dispensed from the closure 26.

Any spilled liquids which drip from the edge of the spout 32 will run down the vertical wall of the spout 32, proceed under the influence of gravity to the gap between the fluid retaining means 28 and the ramp 36 and be received by channel 46. The spilled liquids spreads through channel 46 to projections 48, through the gap between (and radially outward of) projections 48 and fluid retaining means 28 to drain hole 38. The gap between projections 48 and fluid retaining means 28 does not permit shavings in channel 46 to be washed to a location visible to the user or into the container reservoir. When the spilled liquids reach the drain hole 38 the fluid is returned to the container reservoir from which the fluid may be again dispensed, and hence not wasted. If a large quantity of spilled liquids is encountered, the available volume of channel 46 may be filled, causing some of the liquids to flow to the drain hole 38 via ramp 36, short-circuiting channel 46.

The closure 26 is replaced so that the closure attachment means 56 engages the attachment means 54 of the fluid retaining means 28. Any residual liquids left in the closure 26 will then gravity drain inside the fluid retaining means 28 and be returned to the container 20 reservoir in the same manner as described above.

It is recognized that if the container 20 and closure 26 are attached in sealing engagement as shown in FIG. 8, and thereafter the container 20 is tipped from the upright position, or knocked over, no leakage of the liquid product within the container 20 reservoir would result. Furthermore, upon being returned to the upright position, any liquid in the drain means gravity drains back to the container reservoir.

It is recognized that various modifications may be made by those skilled in the art without departure from the spirit and scope of the invention.

What is claimed is:

1. An improved package for liquids, said package comprising:

(a) a hollow container for housing a liquid and having a body with a base at the lower end of the body and an integral upwardly extending pouring spout at the upper end of the body;

(b) a drain means comprising an inclined ramp contiguous said spout, disposed intermediate said spout and said body and having an inclination downward from said spout in an outwardly radial direction;

(c) an upwardly projecting fluid retaining means fused in liquid tight relation to said container and circumscribing the periphery of said ramp in spaced relation therewith to provide an annular gap therebetween;

(d) said drain means further comprising an annular channel below and in fluid communication with said annular gap, whereby said annular channel receives liquids draining from said ramp;

(e) a drain hole leading to the interior of said container, said drain hole being in fluid communication with at least one of said inclined ramp and said annular channel; and (f) at least one projection disposed in and partially blocking said annular channel.

2. The package according to claim 1 wherein said container and projection are blow molded.

3. The package according to claim 1 wherein said at least one projection comprises two projections.

4. The package according to claim 3 wherein each of said projections is generally adjacent said drain hole.

* * * * *